US005715737A

United States Patent [19]

Stauber et al.

[11] Patent Number: 5,715,737

[45] Date of Patent: Feb. 10, 1998

[54] APPARATUS FOR TRIMMING PRINTED PRODUCTS ON AT LEAST TWO BORDERS

[75] Inventors: Hans-Ulrich Stauber, Grüt; Erwin Müller, Dürnten, both of Switzerland

[73] Assignee: Ferag AG, Hinwil, Switzerland

[21] Appl. No.: 456,934

[22] Filed: Jun. 1, 1995

[30] Foreign Application Priority Data

Jun. 8, 1994 [CH] Switzerland ..... 1803/94

[51] Int. Cl.[6] ..... B26D 1/03; B26D 1/38; B65H 35/08

[52] U.S. Cl. ..... 83/154; 83/155; 83/337; 83/349; 83/404.1; 83/409.1; 83/409.2; 83/733; 83/564; 83/934

[58] Field of Search ..... 83/349, 150, 151, 83/154, 582, 583, 564, 934, 404.1, 404.3, 404.4, 675, 592, 409.1, 409.2, 435.1, 404, 337, 303, 435.11–435.19, 733, 155; 271/315, 187; 270/60, 38, 47

[56] References Cited

U.S. PATENT DOCUMENTS

| | | | |
|---|---|---|---|
| 3,069,952 | 12/1962 | Roksvaag | 83/337 |
| 3,844,091 | 10/1974 | Vedvik et al. | 83/337 |
| 3,951,399 | 4/1976 | Reist . | |
| 4,038,893 | 8/1977 | Reist . | |
| 4,058,202 | 11/1977 | Reist et al. | 198/482 |
| 4,201,286 | 5/1980 | Meier . | |
| 4,530,264 | 7/1985 | Felstehausen | 83/337 |
| 4,729,554 | 3/1988 | Honegger | 271/315 |
| 4,801,132 | 1/1989 | Reist | 271/187 |
| 5,110,108 | 5/1992 | Muller | 271/315 |
| 5,113,731 | 5/1992 | Reist . | |
| 5,125,304 | 6/1992 | Petersen . | |
| 5,324,014 | 6/1994 | Honegger et al. | 271/315 |

FOREIGN PATENT DOCUMENTS

| | | |
|---|---|---|
| 0 367 715 | 5/1990 | European Pat. Off. . |
| 0 418 529 | 3/1991 | European Pat. Off. . |
| 0 602 593 | 6/1994 | European Pat. Off. . |
| 2 247 408 | 5/1975 | France . |
| 2 306 800 | 11/1976 | France . |
| 308 330 | 10/1918 | Germany . |
| 28 22 060 | 12/1978 | Germany . |
| 668 216 | 12/1988 | Switzerland . |

*Primary Examiner*—Eugenia Jones
*Assistant Examiner*—Charles Goodman
*Attorney, Agent, or Firm*—Bell, Seltzer, Park & Gibson, P.A.

[57] ABSTRACT

An apparatus for trimming multiple-sheet, folded printed products utilizing two processing drums adjacently arranged. The drums are each rotated about a horizontal axis by a drive mechanism. Each processing drum comprises radial compartments for receiving the printed products to be trimmed. Arranged on each end side of the first processing drum are two stationary cutting elements, one of which is in the operative position. The cutting element interacts with cutting elements which are fastened on the end side of the compartments on the compartment walls. In the first processing drum, the printed products are trimmed on their side borders running at right angles to the folding edge. Arranged on the circumferential edge of the second processing drum are stationary cutting elements with a cutting element in an operative position to interact with cutting elements which are assigned to the individual compartments and are arranged circumferentially in the compartments. The trimming of the open side edge, located opposite the folding edge of the printed products, takes place in the second processing drum. The transfer of the printed products which have been trimmed in the first drum to the second processing drum takes place by means of a conveying arrangement which comprises grippers arranged at regular intervals on a circulating drawing member.

9 Claims, 5 Drawing Sheets

APPARATUS FOR TRIMMING PRINTED PRODUCTS ON AT LEAST TWO BORDERS

BACKGROUND OF THE INVENTION

The present invention relates to an apparatus for trimming sheet-like products, in particular multiple-sheet printed products such as newspapers, periodicals and brochures, on at least two side borders.

A prior art apparatus is disclosed in EP-A-0 367 715 and the corresponding U.S. Pat. No. 5,113,731 wherein multiple-sheet, folded printed products to be trimmed on three sides are fed to a first processing drum with a horizontal axis of rotation wherein the printed products are trimmed on two mutually parallel side borders which run at right angles to the folding edge. The printed products trimmed on two sides then fall, due to the forces of gravity, into the compartments of the second processing drum, which is arranged with a vertical axis of rotation beneath the first processing drum. In this second processing drum, the printed products are trimmed on a third side border, which runs parallel to the folding edge. The compartments of the second processing drum are open on the two end sides of the drum. The printed products are introduced into the compartments of the second processing drum at an end side toward the first processing drum. On the other end side of the second processing drum, trimming takes place with the aid of a stationary cutting element.

With the prior art apparatus, the two processing drums have to be arranged in a very specific manner with respect to one another in order that the transfer of the printed products from the compartments of one processing drum into the compartments of the second processing drum can take place correctly in free fall. However, even with the properly coordinated arrangement of the two processing drums, difficulties occur at high processing speeds when the printed products are transferred from the first processing drum into the second processing drum.

The same applies to the apparatus described in EP-A-0 602 593, pending and commonly owned U.S. applications, Ser. Nos. 08/168,199 and 08/168,415, both filed on Dec. 17, 1993 now, U.S. Pat. Nos. 5,503,051 and 5,501,127, respectively. The apparatus described in these applications differs from the above-mentioned apparatus in accordance with EP-A-0 367 715 only in that the second processing drum with the vertical axis of rotation is arranged upstream of the first processing drum with a horizontal axis of rotation. This means that, in the case of the apparatus in accordance with EP-A-0 602 593 and the above-referenced U.S. Patents, the side border parallel to the folding edge of the printed products is trimmed, and the printed products are then transferred in free fall to the first processing drum with a horizontal axis which is arranged therebeneath and in which the printed products are trimmed on the two side borders at right angles to the folding edge.

SUMMARY OF THE INVENTION

The apparatus, according to the present invention, provides a flexible arrangement of the two processing drums which thereby permits disruption-free introduction of the printed products into the two processing drums.

This is achieved, in part, by providing an apparatus for trimming multiple-sheet printed products such as newspapers, periodicals, brochures and the like, on at least two side borders. The apparatus comprises two processing drums adjacently arranged which are driven about parallel horizontal axes. Each drum comprises radially displaced compartments about their circumferential surfaces which receive the products to be trimmed. The printed products are secured therein by a clamping mechanism for securement during the cutting operation. The first processing drum rotates about its horizontal axis to cooperate with a rotary cutting element which trims the side borders which are perpendicular to a first edge of the printed products.

The second processing drum is positioned with a horizontal axis of rotation adjacent to the first processing drum so the printed products are received by the compartments of the second processing drum. A cutting element associated with the second processing drum cuts the edge of the printed product opposite the first edge. Thus, three edges are accurately cut by the apparatus of the present invention. The arrangement of transporting means between the two processing drums permits easy transferring of the printed products which are trimmed in one processing drum to the compartments of the other processing drum for further trimming.

BRIEF DESCRIPTION OF THE DRAWINGS

Exemplary embodiments of the subject matter of the invention are explained in more detail hereinbelow with reference to the drawings, in which.

DETAILED DESCRIPTION OF THE DRAWINGS

Figure 1:
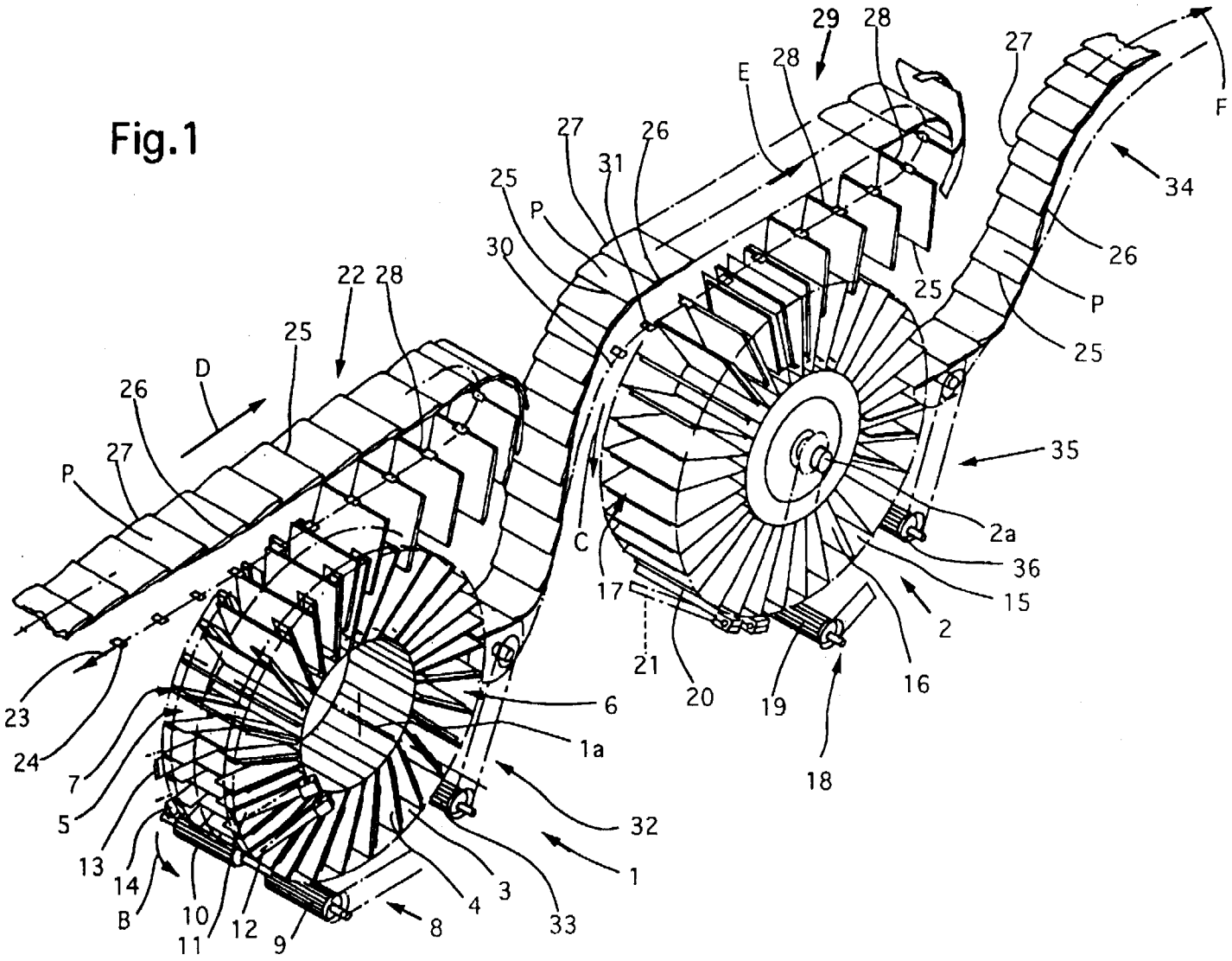
FIG. 1 is a perspective view of a first embodiment of an apparatus according to the present invention.

A first embodiment of the present invention shown in FIG. 1 is an apparatus for trimming multiple-sheet printed products P on three side borders which comprises a first processing drum 1 and a second processing drum 2. The second processing drum is arranged downstream of the first processing drum. The two drums 1, 2 are arranged such that their axes of rotation 1*a* and 2*a*, are parallel and each is horizontal. In the first processing drum 1, the so-called head-edge and tail-edge cutting takes place, i.e. the trimming along the side borders running at right angles to a first edge of the printed products. The first edge may be folded in an embodiment of the present invention although the apparatus according to the present invention is not limited to processing folded printed products. In the second processing drum 2, the so-called fore-edge cutting takes place, i.e. the trimming on that side border which runs parallel to the first edge of the printed products.

The first processing drum 1 corresponds, in terms of construction and mode of functioning, to the processing drum which is intended for head-edge and tail-edge cutting and is described in detail in the above-mentioned EP-A-0 602 593 and the above-referenced U.S. Pat Nos. 5,503,051 and 5,501,127, which are incorporated herein by The processing drum 1 exhibits a number of radially positioned receiving compartments 3 which are separated from one another by compartment walls 4. Provided in each compartment 3 is a clamping member (not shown) for pressing the printed products P onto a compartment wall 4 during the cutting operation so that the printed products P are held firmly. The receiving compartments 3 are open along the circumferential surface 5 and on the two end sides 6 and 7 of the processing drum 1. The processing drum 1 is driven in the direction of the arrow B by a drive 8 (only partially shown) which exhibits two pinions 9, 10, of which each meshes with a toothed rim which is arranged on the circumferential surface of the processing drum 1.

Arranged on each end side 6, 7 of the processing drum 1 are two stationary cutting elements 11, 12 and 13, 14, respectively, which interact with cutting elements which are arranged in the compartments and co-rotate therewith. Of the two stationary cutting elements 11, 12 and 13, 14, in each case one cutting element is located in the operating position, while the other cutting element is in the out-of-operation position. For a more precise description of the stationary cutting elements 11, 12 and 13, 14 and of the rotating cutting elements which interact therewith and are located in the compartments 3, reference may be made to EP-A-0 602 593 and the above-referenced U.S. Pat. Nos. 5,503,051 and 5,501,127, incorporated by reference, which describe the manner in which the side borders of the printed products P on the end sides 6, 7 of the processing drum 1 are trimmed.

The second processing drum 2 likewise exhibits a number of radial receiving compartments which are separated from one another by compartment walls 16. Provided in each compartment 15 is a clamping member (not shown), to which further reference will be made later in conjunction with other figures. The receiving compartments 15 are open at the circumferential surface 17 of the processing drum but, in another embodiment, may also be open on the end sides of the drum 2. The processing drum 2 is driven in the direction of the arrow C by means of a drive (only partially shown). Similarly to the processing drum 1, this drive 18 exhibits pinions 19 which mesh with toothed rims on the circumference of the processing drum 2. The two drives 8 and 18 for the two drums 1 and 2 may either have common or separate drive motors.

It is also conceivable for the processing drum 2 not to be driven at the circumference (as shown), but in the center, e.g., on a shaft which determines the axis of rotation 2*a*.

Arranged on the circumference of the processing drum 2 are two stationary cutting elements 20 and 21, of which the cutting element 20 is shown in the operating position, while the other cutting element 21 assumes its out-of-operation position. The stationary cutting element 20 or 21 located respectively in the operating position interacts with cutting elements which are arranged in the individual compartments 15. The cutting operation taking place at the circumference 17 of the processing drum 2 will be explained in somewhat more detail with reference to FIGS. 4–8.

The printed products P to be trimmed are fed to the compartments 3 of the processing drum 1 by means of a feed conveyor 22, of which the conveying direction is designated by D. Said feed conveyor 22 comprises a circulating drawing member 23 on which controllable grippers 24 are fastened at regular intervals. Said grippers 24 hold the printed products P firmly. As is shown in FIG. 1, the printed products P are fed in imbricated formation with their folding edge 25 in front. The two side borders of the printed products P are designated by 26 and 27. The side edge which is parallel to the folding edge 25 and at which the printed products P are held by the grippers 24 is designated by 28. The feed conveyor 22 is guided such that in each case one printed product P is introduced into a compartment 3 of the processing drum 1 with its folding edge 25 in front.

Provided between the two processing drums 1 and 2 is a conveying arrangement 29 which runs in a conveying direction E. The conveying arrangement 29, too, exhibits a circulating drawing member 30 on which grippers 31 are fastened at regular intervals. The conveying arrangement 29 is driven by a drive 32 which exhibits driving pinions 33 which mesh with the above-mentioned toothed rims on the circumference of the first processing drum 1. The conveying arrangement 29 is thus driven by the first processing drum 1.

The printed products P trimmed on the two side borders 26, 27 in the first processing drum 1 are seized at the side border 28 by the grippers 31 of the conveying arrangement 29 and are conveyed to the second drum 2. The conveying arrangement 29 is designed such that the printed products P are each introduced individually into the receiving compartments 15 of the second processing drum 2 with the folding edge 25 in front.

After the printed products P have been trimmed on their side border 28, i.e. behind the stationary cutting elements 20, 21 as seen in the direction of rotation C of the processing drum 2, the ready-trimmed printed products P are guided away by means of a removal conveyor 34 which runs in a conveying direction F. The removal conveyor 34 is of similar construction to the conveying arrangement 29 and likewise exhibits grippers fastened on a circulating drawing member. The removal conveyor 34 is driven by a drive 35 which exhibits drive pinions 36 which mesh with the above-mentioned toothed rims on the circumference of the processing drum 2. The removal conveyor 34 is thus driven by the second processing drum 2.

Figure 2:
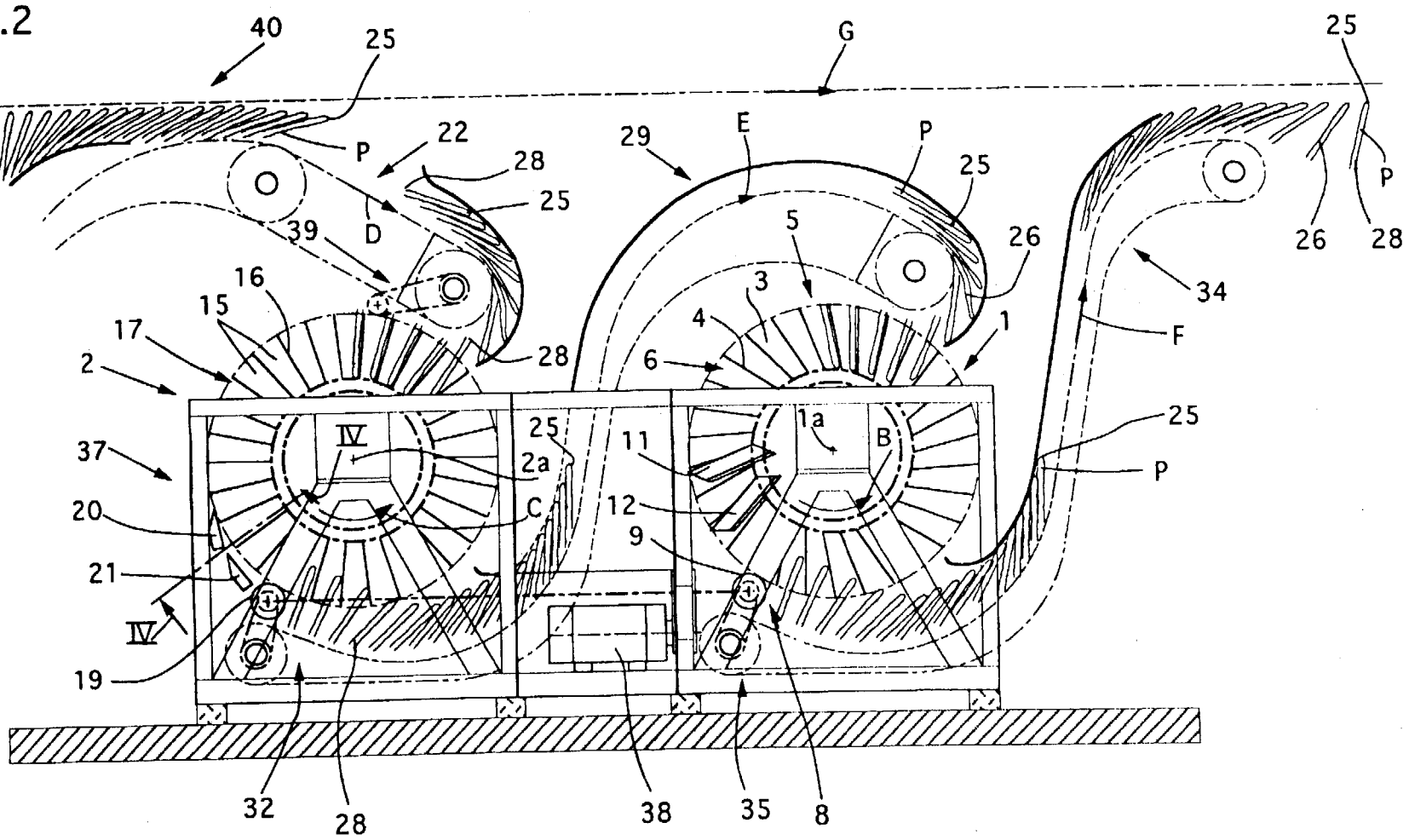
FIG. 2 is a side view of a second embodiment of an apparatus according to the present invention.
Figure 3:
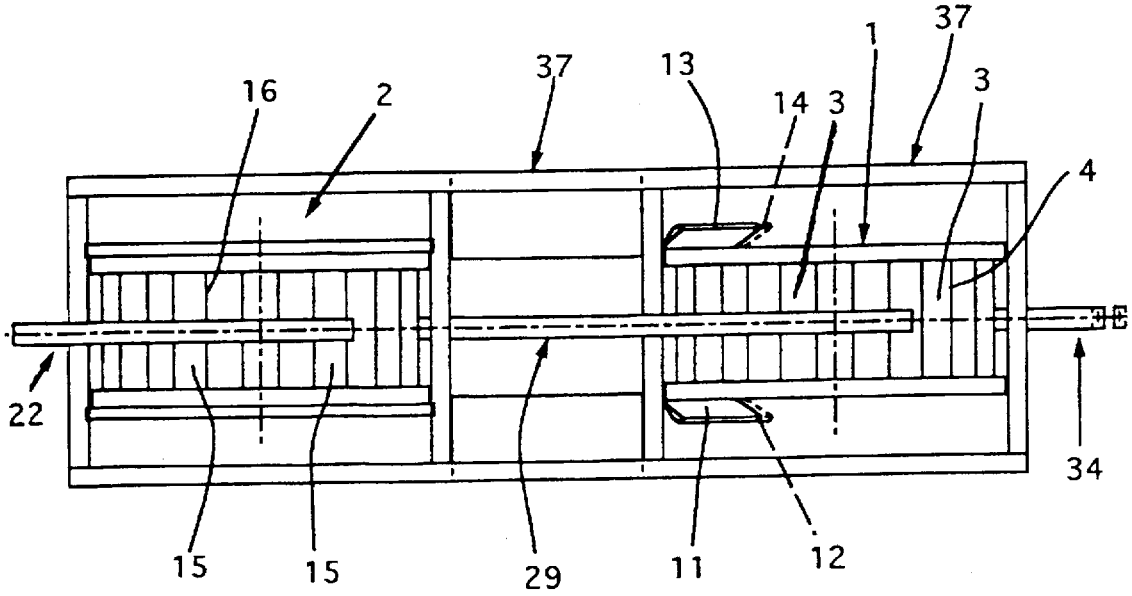
FIG. 3 is a plan view of the apparatus of FIG. 2.

A second embodiment of an apparatus according to the present invention is shown in profile in FIG. 2 and in plan view in FIG. 3, which embodiment differs from the embodiment according to FIG. 1 in that the order of the two processing drums 1 and 2 is reversed. This means that, in the case of the apparatus according to FIG. 2, the processing drum 2 is arranged upstream of the processing drum 1. Otherwise, the two processing drums 1 and 2 are constructed in the same way as is described with reference to FIG. 1. In the case of the embodiment according to FIG. 2, furthermore, the conveying arrangement 29 and the removal conveyor 34 are guided somewhat differently than in the embodiment according to FIG. 1, i.e. in FIG. 2 the removal of the printed products from the processing drums 1 and 2 is represented somewhat differently than in FIG. 1.

The two processing drums 1 and 2 are mounted, in a frame 37 supported on the floor, such that they can be rotated about their axis 1*a* and 2*a*, respectively, in the direction of the arrows B and C respectively, and are driven by a common drive unit 38 as is described with reference to FIG. 1. The feed conveyor 22 is driven by the processing drum 2 via a drive 39, which is represented only schematically.

The printed products P to be trimmed are fed to the feed conveyor 22 in the conveying direction G by a feeding means 40 which comprises individually controllable grippers which are fastened at regular intervals on a circulating drawing member. As can be seen in FIG. 2, the feeding means 40 may also be used to receive the ready-trimmed printed products P from the removal conveyor 34 to convey them further. With this arrangement, defective or damaged printed products P can be separated out upon transfer of the printed products P from the removal conveyor 34 to the feeding means 40.

Figure 4:
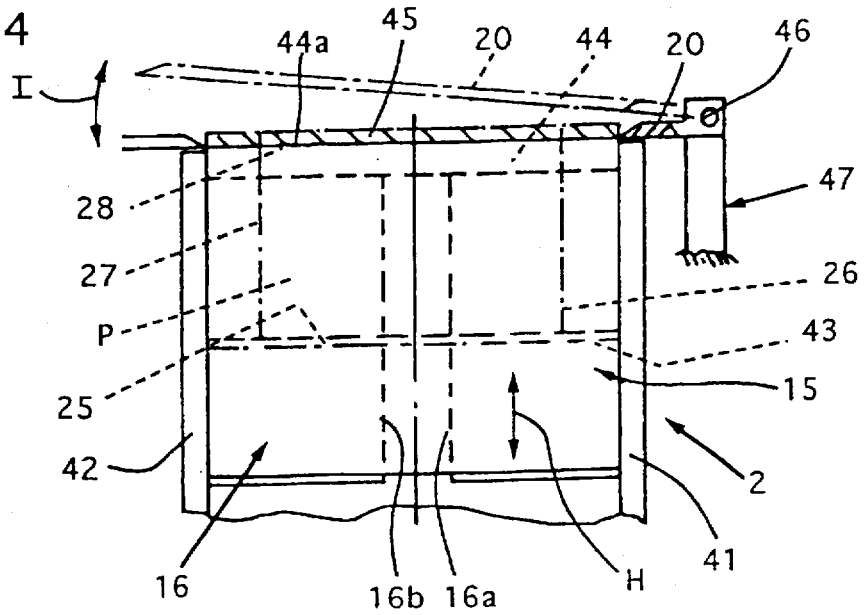
FIG. 4 is a cross-sectional view taken along line IV—IV of FIG. 2.

The design of the processing drum 2 and the arrangement of a stationary cutter 20 can be seen from the representation in FIG. 4, which shows a section through the processing drum 2 along line IV—IV in FIG. 2.

As can be seen in FIG. 4, the processing drum 2 exhibits, on the end sides, two mount parts 41, 42 on which there are fastened wall parts 16*a* and which form the compartment walls 16 between the individual receiving compartments 15. Provided in each compartment is a base part 43 which can be adjusted in the direction of the arrow H in order to be able to carry out an adjustment to various format sizes of the printed products P. The adjustment of the base parts 43 of all the receiving compartments 15 takes place preferably from a central adjustment mechanism (not shown). A printed product P located in the receiving compartment 15 is represented by chain-dotted lines in FIG. 4.

Fastened on the two mount parts 41, 42, in each compartment, are cutting elements 44, of which the cutting edges 44*a* are arranged on the circumference of the processing drum 2 and, in the case of the exemplary embodiment shown, extend over the entire width of the compartments 15. The base parts 43 are adjusted such that the part 45, which is to be cut away on the side border 28, of the printed products P projects beyond this cutting edge 44*a* of the cutting elements 44.

As has already been mentioned, the rotating cutting elements 44 interact with the stationary cutting element 20 which are mounted on a stationary holder 47 such that it can be pivoted about the pivot axis designated by 46. The cutting element 20 can be pivoted, in a manner which is yet to be described, in the direction of the arrow I from the circumference of the processing drum 2 into the out-of-operation position, which is represented by chain-dotted lines in FIG. 4.

A first embodiment of the design and arrangement of the stationary cutting element 20 is explained with reference to FIG. 5, which shows a detail of the processing drum 2.

Figure 7:
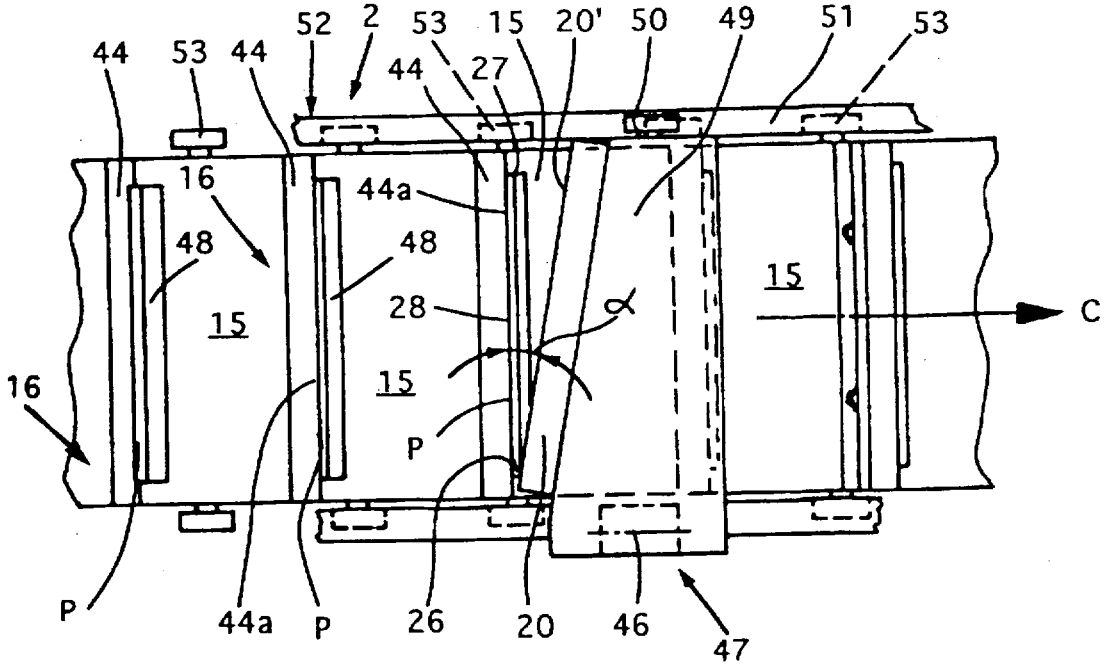
FIG. 7 is a fragmented view of the processing drum according to FIG. 6, taken along the direction of arrow A in FIG. 6.
Figure 5:
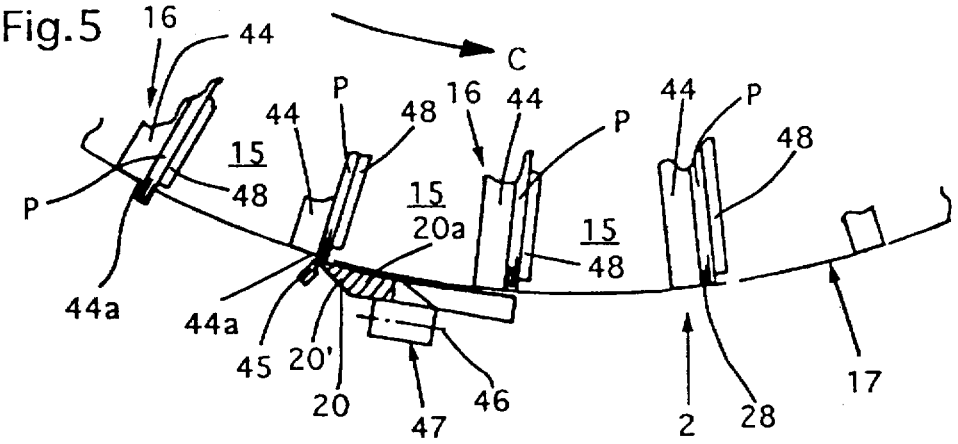
FIG. 5 is a fragmented view of a processing drum according to the first embodiment illustrating a stationary cutting element.

Shown schematically in FIG. 5, the cutting elements 44 form part of the compartment walls 16 onto which the printed products P to be trimmed are pressed by means of controlled clamping members 48. The cutting elements 44 are set such that, upon rotation of the processing drum 2 in the direction of the arrow C, their cutting edge 44*a* moves along a cylindrical outer surface on the circumference 17 of the processing drum 2. The stationary cutting element 20 is fastened on the holder 47 with its cutting edge 20, directed towards the oncoming cutting elements 44. In this arrangement, the cutting element 20, as is shown in FIG. 7, is set obliquely by the angle α with respect to the movement direction of the processing drum 2 in order, together with the rotating cutting elements 44 in the compartments 15, to cut away the part 45, which is to be cut away, of the printed products P in the manner of shears. Since the cutting edge 20' of the stationary cutting element 20 has to be located very close to the circumference 17 of the processing drum 2, it is necessary for the cutting element 20 to be of a curved design on its side 2O*a* which is directed towards the processing drum 2, and the radius of said curvature should correspond approximately to the radius of the processing drum 2. This means that the stationary cutting element 20 has to be subjected on the side 20*a* to machining, e.g. by means of a grinding tool.

Figure 6:
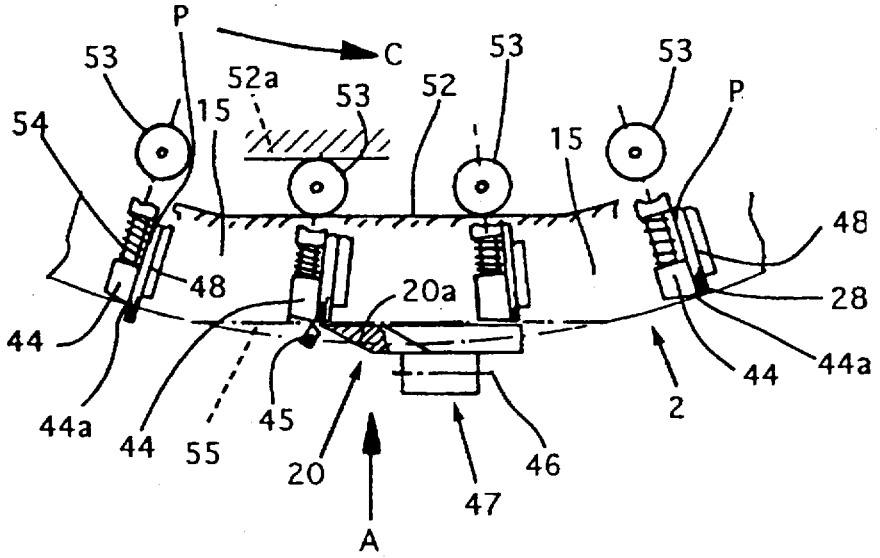
FIG. 6 is a fragmented view of a processing drum according to a second embodiment illustrating a stationary cutting element.

In the embodiment shown in FIGS. 6 and 7, such machining of the stationary cutting element 20 can be dispensed with, but it is necessary to control the rotating cutting elements 44. The mode of representation in FIG. 6 corresponds to that of FIG. 5, while FIG. 7 shows a view in the direction of the arrow A in FIG. 6.

It can be seen from FIG. 7 that the stationary cutting element 20 is fastened on a cutter bar 49 which is mounted on the holder 47 such that it can be pivoted about the axis 46. On its side located opposite the pivot axis 46, the cutter bar 49 bears an eccentrically mounted roller 50, which is formed, in the present case, by a ball bearing. In a manner which is yet to be described with reference to FIG. 8, the roller 50 is pressed against a running surface 51 which is formed on a control guide 52. As can be seen in FIG. 6, said control guide 52 serves for controlling the movement of the cutter bars 49. Said cutter bars 49 are mounted displaceably in the radial direction and are connected to a control roller 53 which, when the processing drum 2 rotates in the direction of the arrow C, runs onto the control curve 52. Upon interaction of the control rollers 53 and the control curve 52, the cutting elements 44 are forced back counter to the action of a compression spring 54, and the cutting edges 44*a* of the rotating cutting elements 44 run along a planar movement path 55 in the region of the stationary cutting element 20. The underside 20*a* of the stationary countercutter 20 may thus be of a planar design.

In order to achieve positive guidance of the control rollers 53, a second control curve, designated by 52*a*, may be provided. As can be seen in FIG. 7, the cutting edge 20' of the stationary cutting element 20, as has already been mentioned, is set obliquely by the angle α with respect to the movement direction C of the rotating cutting elements 44 and the cutting edges 44*a* thereof. It can be seen in FIG. 7 that said arrangement of the cutting element 20 results in a cutting operation which corresponds to that carried out by shears. This means that the trimming of the side border 28 begins at the side border 26 and then continues to the opposite side border With reference to FIG. 8, which shows an axial section through a region of the processing drum with the stationary cutting element 20, the mount of the cutting element 21 will now be explained in more detail. The cutter mount is very similar to that which is described and shown in the above-mentioned EP-A-0 602 593, in particular in the FIGS. 4B, 5–9 thereof. Although, in FIG. 8, a cutting element corresponding to the embodiment according to FIG. 5 is shown, reference is also made to FIG. 7 as regards the cutter mount.

Figure 8:
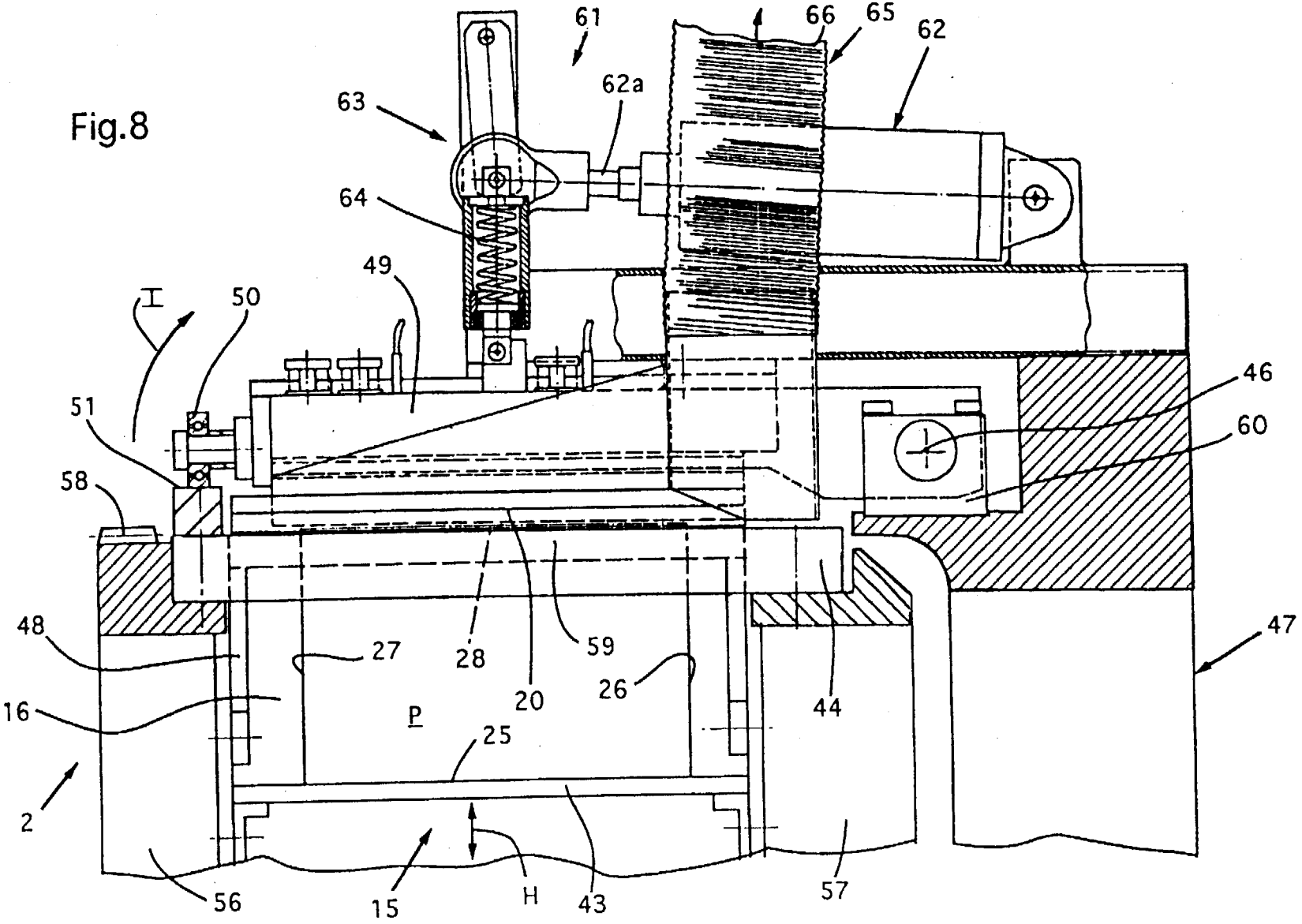
FIG. 8 is an axial sectional view taken through a region of one processing drum with the stationary cutter part.

The processing drum 2, which is partially represented in FIG. 8, exhibits bearing rings 56, 57 which are arranged on the end sides and correspond to the mount parts 41, 42 according to FIG. 4. The bearing ring 56 exhibits, on its circumference, a toothed rim 5*e* which is in engagement with the drive pinion 19 (FIG. 1) of the drive 18 for the processing drum 2. As has already been described in conjunction with FIG. 4, each receiving compartment 15 exhibits a base part 43 which can be adjusted in the direction of the arrow M for adaptation to the format of the printed product P to be trimmed. Provided in each compartment 15 is, as is shown in FIGS. 5 and 6, a clamping member 48 which exhibits a clamping strip 59 which runs parallel to the cutting element 44 which is fastened on the two bearing rings 56, 57. Further description of the control of the clamping member 48, is set forth in the above-mentioned EP-A-0 602 593 and U.S. Pat Nos. 5,503,051 and 5,501,127 applications. By means of the clamping-strip 59, the printed product P to be trimmed is pressed against the compartment wall 16 and the cutting element 44 in the region of the side border to be trimmed.

A ring with the running path 51 for the roller is fastened on the bearing ring 56. The roller 50 is mounted eccentrically and adjustably on the cutter bar 49. The cutter bar 49 bears the cutting element 20 and is mounted so that it can be pivoted about the axis 46, in a cutter bearing 60 which is fastened on the holder 47. By means of an actuating mechanism 61, the cutter bar 49, together with the cutting element 20, can be pivoted in the direction of the arrow I out of the operative or cutting position shown in FIG. 8 into an inoperative position. The actuating mechanism 61 exhibits a cylinder/piston unit 62 of which the piston rod 62*a* is connected to a toggle-lever arrangement 63, which includes a compression spring 64. Said toggle-lever arrangement 63 is connected to the cutter bar 49. By means of the spring 64, the cutter bar 49, with the roller 50, is pressed against the running path 51 and thus positioned. For a more detailed explanation of the construction and mode of operation of the actuating mechanism 61, reference may be made to EP-A-0 602 593 and the above-referenced U.S. Pat. Nos. 5,503,051 and 5,501,127.

An installation 65 for extracting the cut-off material strips is assigned to the cutting element 20. The extraction installation 65 comprises a suction duct 66 which is connected to a mouthpiece (not shown in FIG. 8) which is open towards the cutting gap between the stationary cutting element 20 and the passing cutting element 44.

In the embodiment according to FIGS. 6 and 7 with resiliently mounted cutting elements 44, unlike the representation of FIG. 8, the cutter bars 49 and the clamping members 48 are mounted resiliently. In addition, a stationary control guide 52 for the control rollers 53 (FIGS. 6 and 7) has also to be provided. The holder and mount of the stationary cutting element 2*e*, however, remain the same as is shown in FIG. 8.

The mode of functioning of the two apparatuses shown in FIGS. 1 and 2 should be sufficiently clear from the previous explanations. In summary, it may be said that, in the processing drum 1, the printed products P are trimmed simultaneously, or even one after the other, on two opposite side borders 26, 27, and that, in the processing drum 2, a third side border 28 is trimmed. In this arrangement, the order of the two cutting operations can be freely selected.

Hereinbelow, brief reference is made to certain variants.

Instead of trimming the printed products P on the two side borders 26 and 27 in the processing drum 1, as is shown, it is also possible to carry out cutting on only one side border 26 or 27. It goes without saying that, in the apparatuses described, other types of products may also be trimmed, e.g. bound products which may or may not be folded. The printed products P may also be introduced into the processing drums 1, 2 in a different position than is shown in FIGS. 1 and 2, in particular in a position which is rotated through 90° with respect to the position shown in FIGS. 1 and 2.

The apparatuses described have the advantage that the processing drums 1, 2 can be set up separately from one another, i.e. their mutual position is not determined beforehand, because, for the transfer of the printed products which have been trimmed in one processing drum to the other processing drum, provision is made for a conveying arrangement, the course of which can be freely selected within wide limits. Since both the processing drums 1, 2 are arranged with a horizontal axis of rotation 1*a* and 2*a*, respectively, the printed products P can be introduced into the receiving compartments 3 and 15, respectively, of the processing drums 1, 2 in the upper region of the drum in an approximately radial direction. This permits a controlled, satisfactory introduction of the printed products P into the receiving compartments 3, 15.

If the intention is for the printed products P to be trimmed only on one side edge, the cutting arrangements in one processing drum 1 or 2 are not operated.

While particular embodiments of the invention have been described, it will be understood the invention is not limited thereto since modifications may be made by those skilled in the art, particularly in light of the foregoing teachings. It is, therefore, contemplated by the appended claims to cover any such modifications that incorporate those features of these improvements in the true spirit and scope of the invention.

We claim:

1. An apparatus for trimming products on at least two side borders, said apparatus comprising a first and a second processing drum positioned adjacent one another which are rotated about respective horizontal axes, said drums each comprising, respectively, first and second radially positioned receiving compartments to receive the products to be trimmed, said compartments being separated from one another by compartment walls and within which are arranged a clamping mechanism for clamping the products firmly while being trimmed wherein said first compartments of said first processing drum each comprise an open end along a circumferential surface of said first processing drum and on at least one end side, each of said first compartments comprising a first co-rotating cutting element positioned to interact with a first stationary cutting element to trim a side border of the product located in each of said first compartments, wherein said second compartments of said second processing drum comprise an open end along a circumferential surface of said second processing drum and each of said second compartments comprises a second co-rotating cutting element which is arranged at a circumference of the second processing drum and interacts with a second stationary cutting element to trim another side border of the product located in each of said second compartments, said apparatus further comprising a conveying arrangement between the two processing drums for transporting the products which have been trimmed in one processing drum into the compartments of the other processing drum.

2. An apparatus according to claim 1, wherein the first receiving compartments of the first processing drum are open on two end sides and comprises said first co-rotating cutting element on each of said end sides wherein the first stationary cutting element is provided adjacent to each end side of the first processing drum which interacts with the first co-rotating cutting elements in the receiving compartments of the first processing drum.

3. An apparatus according to claim 1 wherein the conveying arrangement comprises grippers which are arranged on a circulating drawing member to grip the products trimmed in one processing drum and transport said products to the receiving compartments of the other processing drum, said conveying arrangement being driven by said processing drums.

4. An apparatus according to claim 1 wherein said second stationary cutting element of the second processing drum is pivoted about an axis at a right angle to the axis of rotation of said processing drum, to pivot from an operative to an inoperative position.

5. An apparatus according to claim 4 wherein the second stationary cutting element of the second processing drum is fastened on a cutter bar which is mounted on a stationary cutter bearing such that said second stationary cutting element is pivoted about said axis of said second stationary cutting element, wherein an end of second stationary cutting element opposite said axis of said cutter bar is supported at least when said second stationary cutting element is in the operative position by a rotatably mounted roller positioned on an annular surface of the second processing drum.

6. An apparatus according to claim 1 wherein the second stationary cutting element of said second processing drum comprises a cutting edge positioned obliquely with respect to cutting edges of the second co-rotating cutting elements in the receiving compartments so that said cutting edges of said second stationary cutting element and said second co-rotating cutting element form an acute angle therebetween.

7. An apparatus according to claim 1 wherein the second co-rotating cutting elements arranged in the receiving compartments of the second processing drum are mounted to be displaced in a direction facing an interior portion of the receiving compartments and wherein control means on said second co-rotating cutting elements are provided so that when the second processing drum is rotating, cutting edges of the second co-rotating cutting elements are guided along a planar path.

8. An apparatus according to claim 1 comprising a feed conveyor arranged upstream of the two processing drums which feeds the products to be trimmed to one of said processing drums, and said apparatus further comprises a removal conveyor arranged downstream of said other processing drum for guiding away the trimmed products.

9. An apparatus according to claim 1 wherein the first compartments of the first processing drum are open on each end side perpendicular to the circumferential surface, and each of said first compartments further comprises on each open end side the first co-rotating cutting element which interacts with the first stationary cutting element to trim opposite side borders of the product located in each compartment, and wherein the second processing drum trims the products on a third side border which is perpendicular to said opposite side borders.

* * * * *